United States Patent [19]

Adone

[11] Patent Number: 4,772,415

[45] Date of Patent: Sep. 20, 1988

[54] HEAVY DUTY DEGREASER COMPOSITION AND METHOD OF USE

[76] Inventor: Donald J. Adone, 949 Todt Hill Rd., New York, N.Y. 10304

[21] Appl. No.: 944,680

[22] Filed: Dec. 22, 1986

[51] Int. Cl.[4] ..... C11D 3/44; C11D 10/04

[52] U.S. Cl. ..... 252/111; 252/114; 252/118; 252/139; 252/153; 252/162; 252/170; 252/171; 252/173; 252/DIG. 14; 134/40

[58] Field of Search ..... 134/40, 42, 111; 252/118, 122, 153, 162, 170, 114, 139, 171, 173

[56] References Cited

U.S. PATENT DOCUMENTS 4,028,281 6/1977 Millard et al. ..... 134/40
4,380,268 4/1983 Martin ..... 252/170
4,390,465 6/1983 Spekman, Jr. ..... 252/156
4,414,128 11/1983 Goffinet ..... 252/106

*Primary Examiner*—Paul Lieberman
*Assistant Examiner*—John F. McNally
*Attorney, Agent, or Firm*—William R. Moran

[57] ABSTRACT

A water-based, non-toxic, biodegradable, heavy duty degreaser composition is provided which is particularly useful for cleaning containers, engines, pipes, and processing equipment employed in the marine and refining industries. Since the composition is water based and hence does not contain volatile solvents or undesirable petroleum based products, it is environmentally desirable for removing oil from tank, boilers, decks, and the like, and avoids the use of toxic and sometimes highly flammable organic solvents.

16 Claims, No Drawings

HEAVY DUTY DEGREASER COMPOSITION AND METHOD OF USE

FIELD OF THE INVENTION

This invention relates in general to a heavy duty degreaser composition. In one aspect, this invention relates to a degreaser composition which is particularly useful for cleaning containers, engines, pipes, and processing equipment used in the marine and refining industries. In a further aspect this invention is directed to a non-petroleum based degreaser composition which is ideally suited for heavy duty cleaning, particularly in large scale industrial marine and refining applications and which is essentially biodegradable and free of toxic and environmentally unsuitable solvents and diluents.

BACKGROUND OF THE INVENTION

In the past few decades the use of petroleum and its many by-products, has increased markedly to a point where the chemical industry has been challenged to develop more effective and safer measures which will preclude injury to the population and to the environment.

Since the chemical industry and our economy, in general, rely so heavily on petroleum and its by-products, there has been a tremendous need to develop a degreaser composition, which can effectively clean the various types of oils usually encountered in marine and refining equipment, such as engines, ship decks, tanks and the like, and yet does not possess the numerous disadvantages which are inherent in the petroleum based degreasers currently in use.

Although a wide variey of detergent and degreaser compositions have been disclosed in the literature, to date, none of the products disclosed has been entirely satisfactory for use in the marine and oil refining industries where a heavy duty degreaser is routinely needed for cleaning. Known detergent formulations are either too weak or ineffective for use in heavy duty cleaning operations, or if capable of use for such appplications, contain harsh, petroleum based components which are toxic, do not readily degrade and are usually environmentally unsuitable for large scale industrial use.

A variety of surfactants, builders and other additives have been employed in cleaning compositions but to date known has been employed in the unique combination as in the composition of the present invention and which have been found to be particularly useful as a heavy duty degreaser for the marine and refining industries. For applications in other areas numerous products are on the market which contain specific combination of ingredients which are indicated to be suitable for the particular use.

For instance, in U.S. pat. No. 4,380,268 which issued to K. R. Martin on Apr. 19, 1983, there is disclosed and claimed a petroleum and gas well enhancement agent. It is stated in the patent that the recovery of oil and gas is enhanced by the removal of paraffin and other hydrocarbons from wells by flushing the wells with water containing a polymer of a primary alcohol and ethylene oxide plus sodium silicate.

U.S. Pat. No. 4,414,128 issued on Nov. 8, 1983 to P. C. E. Goffinet and claims liquid detergent compositions which are indicated to be particularly useful as hard surface cleaners for general household purposes. The composition is an aqueous liquid detergent composition containing surfactant, sequiterpene and a polar solvent.

There is disclosed a metal plate treating solution in U.S. Pat. No. 4,028,281 which issued on June 7, 1977 to B. Millard et al which is indicated to be an aqueous solution capable of cleaning and imparting a hydrophilic silicate coating onto a metal surface and wherein the solution contains an alkali metal silicate, a water active surfactant and a ferric chelate of ethylenediaminetetraacetic acid.

In U. S. Pat. No. 4,390,465 which issued June 28, 1983 to P. Spekman, Jr., there is disclosed a low temperature composition for plating pretreatment of ferrous metals. This composition is an aqueous solution composed of an alkali metal silicate, an active surfactant, a water conditioner such as the tetrasodium salt of ethylenediaminetetraacetic acid, and a brightener. The solution is indicated to be particularly useful for the pretreatment of ferrous metals which are destined to be plated. The formulation is utilized at a temperature which is slightly above ambient and which may be cooled to demulsify said retaining oils prior to disposal. The linear ethoxylated alcohols disclosed in the patent are organic phosphate ester complexes.

It is therefore an object of the present invention to provide a novel degreaser composition which is particularly useful for cleaning engines, tanks, and processing equipment in both the marine and refining industries. Another object of the present invention is to provide a degreaser composition which is water-based and essentially nontoxic. A further object of this invention is to provide a degreaser composition which avoids the used of organic diluents and other petroleum based solvents. A still further object of the present invention is to provide a degreaser compostion which is ideally suited where a heavy duty degreaser is required. Another object of the present invention is to provide a degreasing composition which has the ability of a pretroleum based degreaser and yet does not contain petroleum or other toxic or harzardeous solvents. A further object is to provide a degreaser composition which does not leave a residue on the surface treated. These and other objects will readily become apparent to those skilled in the art in the light of the teaching herein set forth.

SUMMARY OF THE INVENTION

In its broad aspect, the present invention is directed to a novel, heavy duty degreaser composition which is water-based, essentially nontoxic, biodegradable and has no flash point. The degreaser composition of this invention is comprised of, in per cent by weight:.

(1) from about 7 to about 12 percent of a mixture of $C_9$ to $C_{11}$ primary alcohol ethoxylates containing from about 4 to about 8 moles of ethylene oxide per mole of alcohol;

(2) from about 2 to about 5 percent of an alkali metal silicate;

(3) from about 0.5 to about 2 percent of a liquid alkaline metal hydroxide solution;

(4) from about 1.5 to about 4 percent of isopropanol;

(5) from about 0.2 to about 1 percent of a tetraalkaline metal salt of ethylenediaminetetraacetic acid tetrahydrate; and (6) the balance water.

DETAILED DISCUSSION OF THE INVENTION

As indicated above, the composition of the present invention is comprised of a unique combination of at least five ingredients dissolved in an aqueous vehicle. Since the active ingredients of the composition are contained in an aqueous medium, the use of petroleum based components such as solvents and diluents which can be toxic and environmentally undesireable are avoided. Moreover, the composition even in concentrated form, has essentially no flash point and accordingly presents no fire hazards in storage, transportation, or use as opposed to petroleum based degreasers currently in use. It will be evident from the formulation set forth above, that the novel degreaser of this invention contains no chlorinated hydrocarbons. Additionally, the use of the composition of this invention does not leave a residue on the treated surface and thus it is particularly attractive for cleaning containers, tanks and the like where a residue free surface is desired.

Hence, for the first time, one need not resort to the use of highly flammable, toxic, nonbiodegradeable, petroleum-based degreaser in those instances where a heavy duty cleaning compostion is required.

It has been observed that in order to provide a degreaser composition useful for heavy duty cleaning, particularly in the marine and refining industries, the concentration of the active ingredients should be within the weight percentages indicated. Thus, the composition is comprised of, in increasing order of concentration, (a) from about 0.2 to about 1 weight percent of a tetra-alkaline metal salt of ethylenediaminetetraacetic acid (EDTA); (b) from about 0.5 to about 5 weight percent of an alkali metal metasilicate which can be either anhydrous or the pentahydrate; (c) from about 1.5 to about 4 weight percent of isopropanol; (d) from about 7 to about 12 weight percent of the reaction product of $C_9$–$C_{11}$ primary alcohol and ethylene oxide; and (e) the balance being water.

As indicated, the alcohol ethyoxylate is a mixture of $C_9$–$C_{11}$ alcohol ethoxylates with an average of about 6 moles of ethylene oxide per mole of alcohol. The product is prepared from linear primary alcohols of nine to eleven carbon atoms and is ethoxylated with ethylene oxide by known techniques. It is slightly viscous liquid having a melting point of 42°–48° F. a pour point of 45° F., and is completely water soluble. The product is manufactured by the Shell Oil Company under the tradename Neodol.

The ethylenediaminetetraacidic acid salt employed in the degreaser composition of the present invention is preferably the tetrasodium salt tetrahydrate. This product is a white solid soluble in water and is marketed by the Dow Chemical Co. of Midland Michigan under the tradename Versene R.

Although the composition of this invention is preferable utilized as the aforementioned formulation, the novel degreaser composition can, if desired, contain other components or additives as long as they do not adversely effect the degreasing properties of the composition.

For example, it may be desireable to employ thickening agents to insure prolonged contact of the composition with the surface containing the oil or grease material. In many instances the surfaces may be of an odd shape or in difficult to reach places, such as engine parts, tank interiors, and the like. Moreover, the surface to be cleaned may not be level or horizontal and it would be advantageous to delay the composition from flowing away from such surfaces before the degreasing of the surface can be completed.

A wide variety of thickening agents can be employed in the preparation of the degreaser composition of the present invention. In general, the preferred thickening agents are the cellulosic polymers, including the alkyl cellulose ethers, hdroxyalkyl cellulose ethers and the carboxyalkyl cellulose ethers. Illustrative cellulosic polymers, include but are not limited to hydroxymethyl cellulose, carboxymethylcellulose, and the like. Also suitable are the polyalkylene glycols such as polyethylene glycol, the polyethylene oxides, and the like.

Natural polymeric thickeners can also be employed such as the gum based thickeners, i.e., guar gum and its derivatives, gum tragacanth and the like.

The novel degreaser composition of the present invention can, if desired, also contain other additives such as dyes, or other coloring agents, perfumes, abrasives, siliceous materials, mineral materials, such as pumice or perlite, diatomaceous earth and a variety of clays.

Additionally it may be desireable or advantageous to use the composition as a foam and dispense it from a closed system such as an aerosol container. Since no toxic or petroleum based solvents are present, the composition is easily formulated for such applications.

The preparation of the degreaser composition of the present invention is accomplished be mixing the various ingredients in the weight percentages indicated. Since all of the components are essentially water soluble, with the alcohol ethoxylate and isopropanol already in liquid form, blending the various components presents no unusual problem. Unsual caution should of course be exercised in the prepraration of the alkaline metal hydroxide solution and its dilution due to its exothermic nature. Blending can be accomplished using available blending equipment. As previously indicated, since no highly volatile components are employed there are no flammability hazards in preparing the composition.

Depending upon the particular use, the degreasing composition of this invention can be used directly at full strength or it can be diluted to a any desired concentration. The final concentration at which the degreasing composition is used will, of course, depend upon a variety of factors such as mode of application, whether the composition is heated or not, such as in steam applications, length of contact time with the surface being cleaned and the like.

Accordingly, the composition can be employed at full strength for particularly heavy jobs, such as spills of heavy oils like Bunker C oil. However, one of the unique features of the degreasing composition of this invention is that degreasing is effective even at less than full strength and even when the material being removed is particularly difficult to solubilize. For example, it has been observed that the degreaser composition of the present invention when diluted with 5 to 10 parts of water is still very effective for heavy duty cleaning pruposes. Thus for extra heavy duty cleaning such as required for holding tanks, engines, cosmoline, carbon on engine heads, Bunker C oil, or grease traps, the degreaser composition can be used at full strength or at a 1 to 5 dilution with water. For heavy duty cleaning such as decks, platforms, engine room, bulkheads, soil-stained concrete, Degas tanks and barge compartments, petroleum base drilling muds, creosote, and the like, a 5 to 10 dilution of the degreaser composition has been found to be satisfactory.

Normal cleaning such as bilges, exhaust stack smoke. rubber clothing, oil-soaked ground and beach sand, mold, mildew, algae, water-line scum, teakwood decks, carpeting and the like, can be accomplished with a dilution of from 10 to 20 times that of the concentrated composition.

In practice, the degreaser composition of the present invention is used in the same manner as conventional cleaning agents, However, in ,view of its unique formulation a lesser amount, or lower concentration may achieve the same results as that obtained with commercially available degreaser compositions. Since the composition is water based, no problems are encountered in heating the solution and in spraying the solution in those applications wherein such procedures are desired. For instance, the use of the degreaser composition of the present invention allows hot work to continue in areas adjacent to where the cleaning is done since there is no danger of fire due to the cleaning composition.

Accordingly, the degreaser composition can be employed cold or as a hot pressure wash in conjunction with steam cleaning. Thus the degreaser composition can be drawn from an auxilary source and metered into water or steam to give the proper dilution at the nozzle.

It is accordingly evident from the foregoing description that the degreaser composition of this invention contains no phosphates, chlorinated hydrocarbon solvents, or other halogen containing compounds. Moreover, the composition while infinitely soluble in water, is also soluble in a 3 percent saline solution.

The composition is therefore useful for the removal of light distillates, mineral oils, heavy grease and the like. It has also been observed that the degreaser composition is effective in cleaning not only mineral oils, but oils of a vegetable or animal origin.

As indicated the degreaser composition can be utilized with tank cleaning equipment, pressures washers, steam machine and the like and is particulary efficient for cleaning and degreasing machine parts, diesel engine exteriors, compressor exteriors, tank tops, bulkheads, decks, plates and general deck and engine room degreasing and the like.

Although the invention has been illustrated by the preceding description, it is not to be construed as being limited to the materials disclosed, but rather the invention is directed to the generic area as hereinbefore disclosed. Various modifications can be made without departing from the spirit or scope thereof.

What is claimed is:

1. A water-based heavy duty degreaser composition useful for cleaning oil and grease from surfaces, said composition being consisting essentially of of by weight:

(1) from about 7 to about 12 per cent of a mixture of $C_9$ to $C_{11}$ primary alcohol ethoxylates containing from about 4 to about 8 moles of ethylene oxide per mole of alcohol;

(2) from about 2 to about 5 percent of an alkali metal silicate;

(3) from about 0.5 to about 2 percent of a liquid alkaline metal hydroxide solution;

(4) from about 1.5 to about 4 percent of isopropanol;

(5) from about 0.2 to about 1 percent of a tetraalkaline metal salt of ethylenediaminetetraacetic acid tetrahydrate; and (6) the balance water.

2. The water-based heavy duty degreaser composition of claim 1 where said primary alcohol ethoxylates are linear.

3. The water-based heavy duty degreaser composition of claim 1 wherein said alcohol ethoxylates contain 6 moles of ethylene oxide per mole of alcohol.

4. The water-based heavy duty degreaser composition of claim 1 wherein said alkali metasilicate is sodium metasilicate.

5. The water-based heavy duty degreaser composition of claim 1 wherein said alkali metal hydroxide is sodium hydroxide.

6. The water-based heavy duty degreaser composition of claim 1 wherein said tetrahydrate is tetrasodium ethylenediaminetetraacetic acid tetrahydrate.

7. The water-based heavy duty degreaser composition of claim 1 wherein said composition is diluted with from about 1 to about 5 parts of water per part of said degreasing composition.

8. The water-based heavy duty degreaser composition of claim 1 wherein said composition is diluted with from about 5 to about 10 parts of water per part of said degreasing composition.

9. The water-based heavy duty degreaser composition of claim 1 wherein said composition is diluted with from about 10 to about 20 parts of water per part of said degreasing composition.

10. The water-based heavy duty degreaser composition of claim 1 wherein said composition is diluted with from about 5 to about 50 parts of water per part of said degreasing composition.

11. A water-based heavy duty degreaser composition useful for cleaning oil and grease from surfaces, said composition being consisting essentially of of by weight:

(1) about 9 percent of a mixture of linear $C_9$ to $C_{11}$ primary alcohol ethoxylates having an average of about 6 moles of ethylene oxide per mole of alcohol;

(2) about 3.7 percent of an alkali metal silicate;

(3) about 1 percent of a 50 weight percent liquid alakine metal hydroxide solution;

(4) about 2.5 percent of isopropanol;

(5) about 0.3 percent of a tetrasodium salt of ethylenediaminetetraacetic acid tetrahydrate; and (6) the balance water.

12. a process for cleaning oil and grease from surfaces which comprised contacting said oil with the water-based heavy duty degreaser composition consisting essentially of of:

(1) from about 7 to about 12 percent of a mixture of $C_9$ to $C_{11}$ primary alcohol ethoxylates containing from about 4 to about 8 moles of ethylene oxide per mole of alcohol;

(2from about 2 to about 5 percent of an alkali metal silicate ;

(3) from about 0.5 to about 2 percent of a liquid alkaline metal hydroxide solution;

(4) from about 1.5 to about 4 percent of isopropanol;

(5) from about 0.2 to about 1 percent of a tetraalkaline metal salt of ethylenediaminetetraacetic acid tetrahydrate; and (6) the balance water, and thereafter washing said surface with water.

13. A process for cleaning oil and grease from surfaces which comprised contacting said oil and grease with a composition consisting essentially of of by weight:

(1) about 9 percent of a mixture of linear $C_9$ to $C_{11}$ primary alcohol ethoxylates having an a of about 6 moles of ethylene oxide per mole of alcohol;

(2) about 3.7 percent of an alkali metal silicate;

(3) about 1 percent of a 50 weight percent liquid alkaline metal hydroxide solution;

(4) about 2.5 percent of isopropanol;

(5) about 0.3 percent of a tetrasodium salt of ethylenediaminetetraacetic acid tetrahydrate;

(6) the balance water, and thereafter washing said surface with water.

14. The process of claim 12 wherein said oil is Bunker C crude oil.

15. The process of claim 13 wherein said oil is present in a refining processing equipment.

16. The process of claim 13 wherein said oil is present in marine equipment.

* * * * *